US009427041B2

(12) United States Patent
Lupinek et al.

(10) Patent No.: US 9,427,041 B2
(45) Date of Patent: Aug. 30, 2016

(54) ARTICLE OF FOOTWEAR WITH A HEATING SYSTEM

(75) Inventors: Jaroslav J. Lupinek, Portland, OR (US); Patricia L. Smaldone, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 485 days.

(21) Appl. No.: 13/597,506

(22) Filed: Aug. 29, 2012

(65) Prior Publication Data

US 2014/0059882 A1 Mar. 6, 2014

(51) Int. Cl.

| | |
|---|---|
| ***A43B 7/02*** | (2006.01) |
| ***A43B 7/04*** | (2006.01) |
| ***A43B 3/00*** | (2006.01) |
| ***A43B 5/04*** | (2006.01) |
| ***A43B 7/34*** | (2006.01) |

(52) U.S. Cl.

CPC ..... *A43B 7/04* (2013.01); *A43B 3/0015* (2013.01); *A43B 5/0405* (2013.01); *A43B 7/34* (2013.01)

(58) Field of Classification Search

CPC ..... A43B 7/34; A43B 7/04; A43B 7/02; A43B 7/025; A43B 3/0015; A43B 5/0405; A43B 23/07; A43B 5/0409; H05B 2203/036

USPC ..... 36/2.6, 55, 77 R; 219/200, 211

See application file for complete search history.

(56) References Cited

U.S. PATENT DOCUMENTS

| | | | | |
|---|---|---|---|---|
| 73,010 A | | 1/1868 | Holland | |
| 1,702,583 A | | 2/1929 | Williams | |
| 3,293,405 A | * | 12/1966 | Costanzo | H05B 3/342 2/239 |
| 3,392,264 A | * | 7/1968 | Arron | A43B 3/0005 219/211 |
| 3,569,666 A | * | 3/1971 | Murphy | A41D 19/01535 126/204 |
| 3,632,966 A | * | 1/1972 | Arron | H05B 3/342 2/158 |
| 3,644,704 A | | 2/1972 | Polly, Sr. | |
| 3,663,796 A | | 5/1972 | Hines et al. | |
| 3,859,496 A | | 1/1975 | Giese | |
| 3,935,856 A | | 2/1976 | Loftin | |
| 4,023,282 A | | 5/1977 | Ziegelheafer | |
| 4,094,080 A | | 6/1978 | Sanders | |
| 4,455,764 A | | 6/1984 | Rock et al. | |
| 4,507,877 A | * | 4/1985 | Vaccari et al. | 36/2.6 |

(Continued)

FOREIGN PATENT DOCUMENTS

| | | |
|---|---|---|
| CN | 2862760 | 1/2007 |
| CN | 201523713 | 7/2010 |

(Continued)

OTHER PUBLICATIONS

International Search Report and Written Opinion mailed Dec. 18, 2013 in International Application No. PCT/US2013/056933.

(Continued)

*Primary Examiner* — Anna Kinsaul
*Assistant Examiner* — Carolyn W Davis
(74) *Attorney, Agent, or Firm* — Plumsea Law Group, LLC

(57) ABSTRACT

A heated article of footwear that includes an outer shell and a removable inner liner is described. The inner liner includes a heating system with a toe cap heating element. The toe cap heating element is disposed around a perimeter of the forefoot region of the inner liner. The heating system is integrated within the inner liner and is removable with the inner liner from the outer shell. A power source for the heating system is contained within a battery compartment area disposed along a cuff of the inner liner to provide access to the power source.

20 Claims, 8 Drawing Sheets

(56) References Cited

U.S. PATENT DOCUMENTS

| | | | | | |
|---|---|---|---|---|---|
| 4,523,392 | A | * | 6/1985 | Gabrielli | 36/10 |
| 4,651,446 | A | | 3/1987 | Yukawa | |
| 4,665,308 | A | | 5/1987 | Courvoisier et al. | |
| 4,697,363 | A | * | 10/1987 | Gamm | 36/136 |
| 4,705,935 | A | * | 11/1987 | Traffanstedt | A41B 11/00 219/211 |
| 4,841,646 | A | | 6/1989 | Maurer, Jr. | |
| 4,862,603 | A | | 9/1989 | Balbinot | |
| 4,894,931 | A | | 1/1990 | Senee et al. | |
| 4,910,881 | A | * | 3/1990 | Baggio et al. | 36/2.6 |
| 5,063,690 | A | | 11/1991 | Slenker | |
| 5,105,067 | A | | 4/1992 | Brekkestran et al. | |
| 5,140,131 | A | | 8/1992 | Macher et al. | |
| 5,500,635 | A | | 3/1996 | Mott | |
| 5,623,772 | A | * | 4/1997 | Sunderland | A43B 3/0031 219/211 |
| 5,640,786 | A | | 6/1997 | Buyayez | |
| 5,829,171 | A | | 11/1998 | Weber et al. | |
| 5,894,686 | A | | 4/1999 | Parker et al. | |
| 6,003,248 | A | | 12/1999 | Hilgarth | |
| 6,657,164 | B1 | | 12/2003 | Koch | |
| 6,776,498 | B2 | | 8/2004 | Yeung | |
| 6,841,757 | B2 | | 1/2005 | Marega et al. | |
| 7,186,957 | B2 | | 3/2007 | Martin | |
| 7,202,443 | B2 | | 4/2007 | Rock et al. | |
| 7,268,320 | B2 | | 9/2007 | Rock et al. | |
| 7,631,382 | B2 | | 12/2009 | DiBenedetto et al. | |
| 7,841,107 | B2 | | 11/2010 | Braynock et al. | |
| 8,087,186 | B2 | | 1/2012 | Rastegar et al. | |
| 2004/0020074 | A1 | * | 2/2004 | Brait | A43B 5/0405 36/2.6 |
| 2004/0244221 | A1 | | 12/2004 | Hall et al. | |
| 2005/0167412 | A1 | | 8/2005 | Anson et al. | |
| 2005/0246823 | A1 | * | 11/2005 | Groom | A41D 27/205 2/247 |
| 2006/0201025 | A1 | | 9/2006 | Chou | |
| 2006/0248747 | A1 | | 11/2006 | Reid | |
| 2007/0039201 | A1 | | 2/2007 | Axinte | |
| 2007/0089318 | A1 | | 4/2007 | Ferguson | |
| 2007/0164010 | A1 | * | 7/2007 | Rock | A41D 31/0038 219/212 |
| 2009/0013554 | A1 | | 1/2009 | Macher et al. | |
| 2009/0032520 | A1 | | 2/2009 | Cronn | |
| 2009/0288317 | A1 | | 11/2009 | Forbes | |
| 2010/0212183 | A1 | * | 8/2010 | Seliger | A43B 5/0405 36/2.6 |
| 2010/0328088 | A1 | | 12/2010 | Lin et al. | |
| 2011/0083339 | A1 | | 4/2011 | Luo | |
| 2011/0107771 | A1 | | 5/2011 | Crist et al. | |
| 2011/0225849 | A1 | | 9/2011 | Zubyk | |
| 2011/0239488 | A1 | | 10/2011 | Carnes et al. | |
| 2011/0308113 | A1 | | 12/2011 | Hartford et al. | |
| 2012/0005919 | A1 | | 1/2012 | Chen | |
| 2012/0018418 | A1 | | 1/2012 | Shantha et al. | |
| 2012/0188750 | A1 | | 7/2012 | Marston | |
| 2014/0059894 | A1 | | 3/2014 | Lupinek et al. | |

FOREIGN PATENT DOCUMENTS

| | | | | | |
|---|---|---|---|---|---|
| CN | 201813956 | | | 5/2011 | |
| CN | 201869866 | | | 6/2011 | |
| DE | 102010055761 | | * | 6/2012 | A43B 5/04 |
| DE | 102010055761 | A1 | * | 6/2012 | A43B 5/04 |
| EP | 1872931 | | | 1/2008 | |

OTHER PUBLICATIONS

International Search Report and Written Opinion mailed Dec. 18, 2013 in International Application No. PCT/US2013/056936.

Kalinich, Sean, "Columbia Sportswear Now Selling Bugathermo Rechargable, Heated, Boots", http://www.vrworld.com/2009/10/14/columbia-footwear-now-selling-bugathermo-rechargable2c-heated2c-boots/, Oct. 14, 2009, pp. 1-12.

ZapposGear, "Columbia Bugathermor™ 7658139", https://www.youtube.com/watch?v=fZZEtJY8kyM, Nov. 10, 2010.

Office Action mailed Dec. 16, 2014 in U.S. Appl. No. 13/597,874.

International Preliminary Report on Patentability (including Written Opinion of the ISA) mailed Mar. 12, 2015 in International Application No. PCT/US2013/056933.

International Preliminary Report on Patentability (including Written Opinion of the ISA) mailed Mar. 12, 2015 in International Application No. PCT/US2013/056936.

* cited by examiner

ARTICLE OF FOOTWEAR WITH A HEATING SYSTEM

BACKGROUND

The present invention relates generally to an article of footwear, and more specifically, to an article of footwear with a heating system.

Heated articles of footwear and heated insoles for use in articles of footwear are known in the art. U.S. Pat. No. 5,623,772 to Sunderland discloses a foot warming system for a boot that includes a heating element fit inside a cavity in a molded insole. U.S. patent application publication number 2004/0020074 to Brait et al. discloses a heater device disposed either above or below a forefoot region of an inner shoe.

There exists a need in the art for a heated article of footwear that is configured with a heating system that is easily removable and accessible by a wearer.

SUMMARY

In one aspect, the invention provides an article of footwear comprising: an outer shell, the outer shell including an upper and a sole structure; an inner liner, the inner liner being configured to be removably inserted within an interior of the outer shell; the inner liner further comprising a heating system, the heating system including a power source and a heating element; the inner liner having an upper liner portion and a lower liner portion, wherein the upper liner portion includes a cuff; wherein the cuff includes a battery compartment area disposed in between an outer layer of the inner liner and an inner layer of the inner liner, the battery compartment area being configured to receive the power source of the heating system; and wherein the heating element is a toe cap heating element that is disposed along an outer perimeter of a forefoot region of the lower liner portion of the inner liner.

In another aspect, the invention provides an article of footwear comprising: an outer shell, the outer shell including an upper and a sole structure; an inner liner, the inner liner being configured to be removably inserted within an interior of the outer shell; the inner liner further comprising a heating system, the heating system including a power source and a heating element; the inner liner having an upper liner portion and a lower liner portion; the lower liner portion including a bottom disposed along an underside of the inner liner, the bottom being configured to rest along a bottom of the interior of the outer shell when the inner liner is inserted within the outer shell; the lower liner further comprising a top forefoot portion disposed along a top of the inner liner in a forefoot region and a toe cap perimeter disposed along an outer edge of the forefoot region, the toe cap perimeter extending between the bottom of the lower liner and the top forefoot portion; and wherein the heating element is disposed along the toe cap perimeter of the lower liner portion of the inner liner.

In another aspect, the invention provides an article of footwear comprising: an outer shell, the outer shell including an upper and a sole structure; an inner liner, the inner liner being configured to be removably inserted within an interior of the outer shell; the inner liner further comprising a heating system, the heating system including a power source and a heating element; the inner liner having an upper liner portion and a lower liner portion, wherein the upper liner portion includes a cuff disposed along a top edge of the upper liner portion and extending downwards along a front edge of the upper liner portion; wherein the cuff includes a battery compartment area disposed in between an outer layer of the inner liner and an inner layer of the inner liner, the battery compartment area being configured to receive the power source of the heating system; and wherein the battery compartment area comprises a fastening mechanism that is configured to join the outer layer with the inner layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
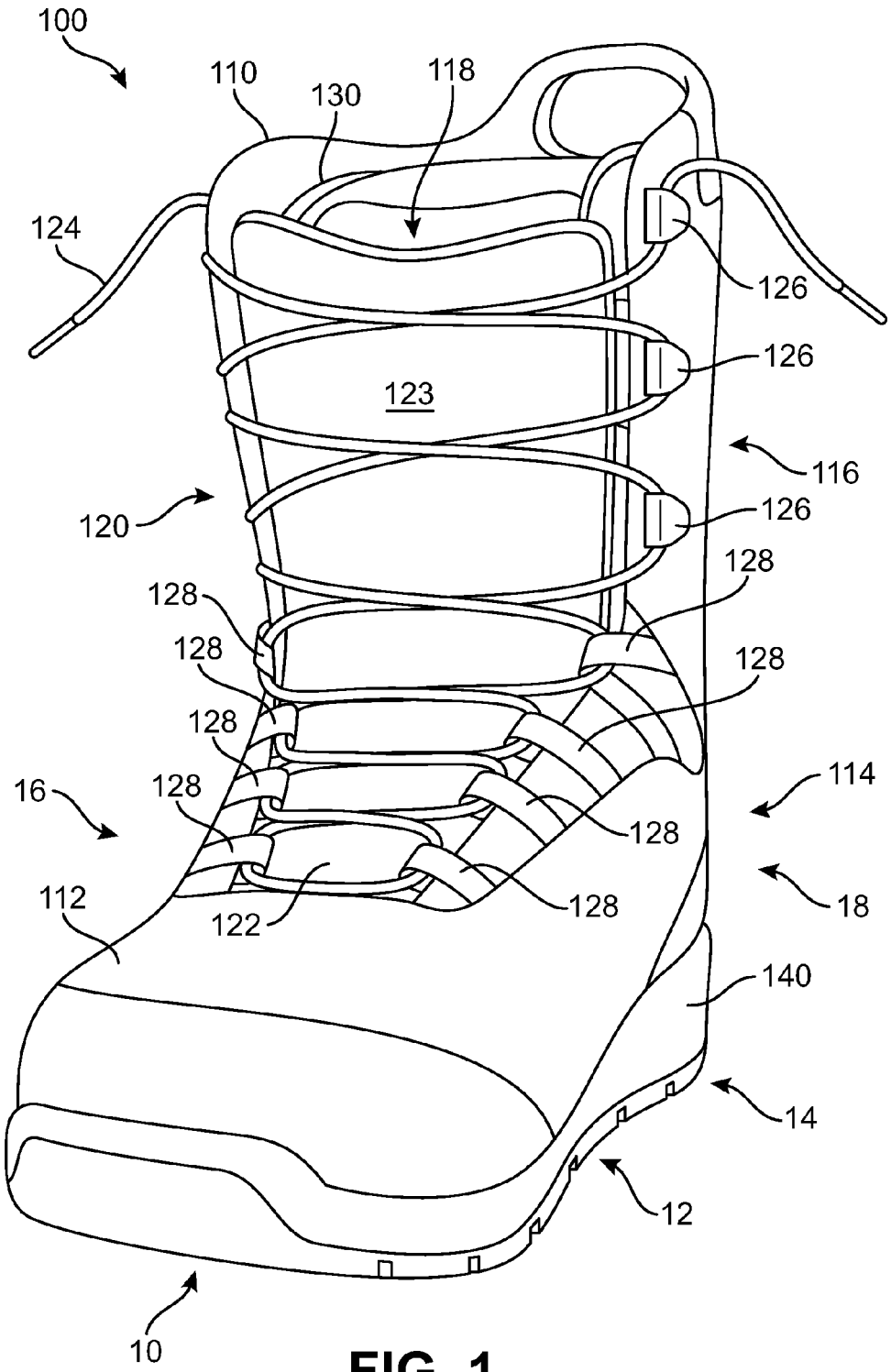
FIG. 1 is an isometric view of an exemplary embodiment of an article of footwear.
Figure 2:
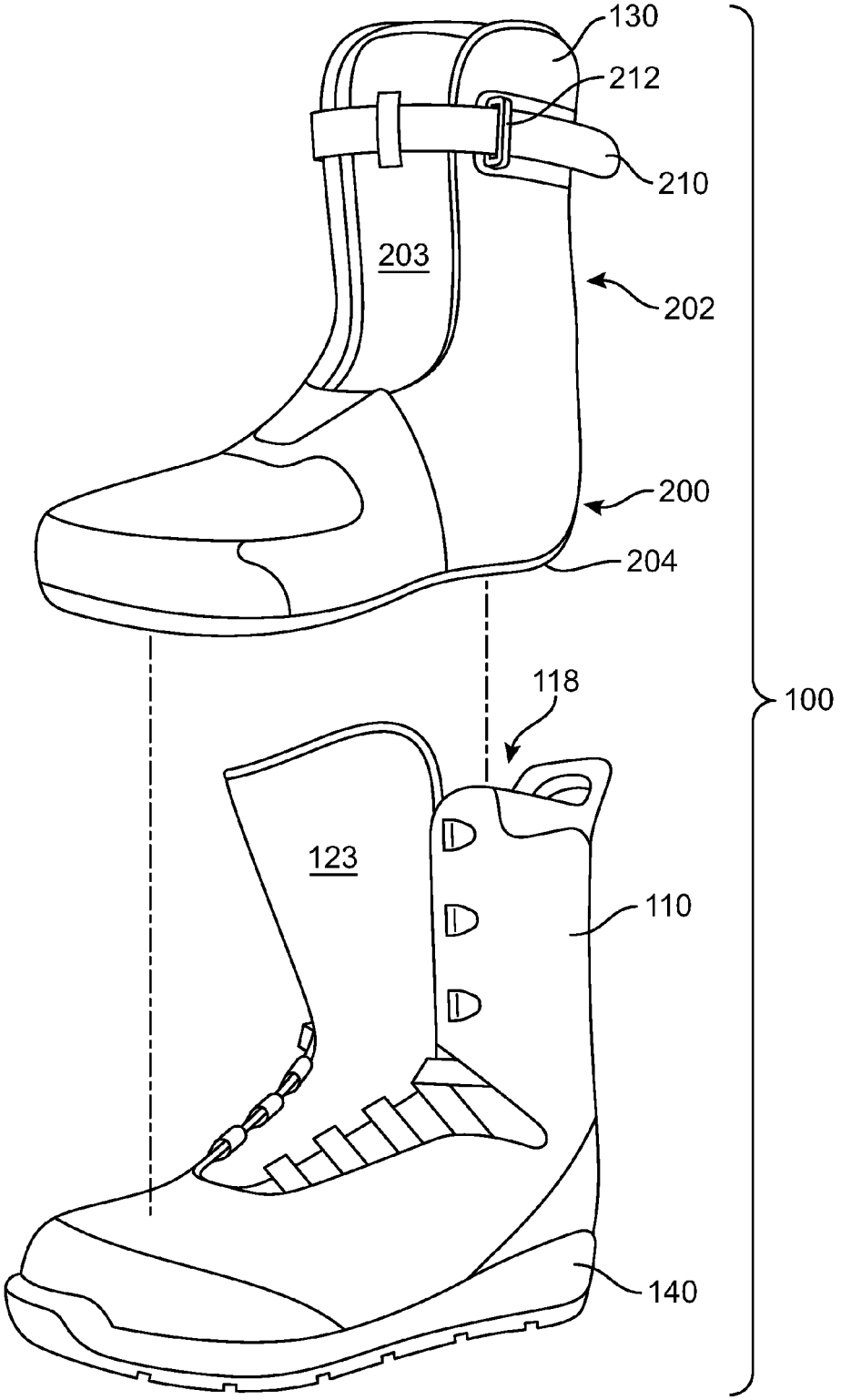
FIG. 2 is an exploded isometric view of an exemplary embodiment of an article of footwear.

FIGS. 1-2 illustrate an exemplary embodiment of article of footwear 100. In particular, FIG. 1 illustrates an isometric view of an exemplary embodiment of article of footwear 100 and FIG. 2 illustrates an exploded isometric view of an exemplary embodiment of article of footwear 100. For clarity, the following detailed description discusses an exemplary embodiment, in the form of a boot, but it should be noted that the present invention could take the form of any article of footwear including, but not limited to: hiking boots, soccer shoes, football shoes, sneakers, rugby shoes, baseball shoes as well as other kinds of shoes. Furthermore, the exemplary embodiments illustrate a boot configured to be used for snowboarding, however, in other embodiments the boot could be used for other activities such as hiking, skiing, or any other type of activity in which boots may be used.

As shown in FIGS. 1-2, article of footwear 100, also referred to simply as article 100, can be used with a right foot. It is understood that the following discussion may equally apply to a mirror image of article of footwear 100 that can be used with a left foot. Features discussed herein may apply equally well for an article of footwear configured for use with a left foot or for a right foot. However, some features discussed herein or configurations shown may provide particular advantages to an article of footwear configured for use with either a left foot or a right foot, such as a snowboard boot arranged for use as the lead boot for a user having a left or goofy foot stance.

For purposes of reference, article 100 may be divided into forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot region 10, midfoot region 12 and heel region 14.

It will be understood that forefoot region 10, midfoot region 12 and heel region 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot region 10, midfoot region 12 and heel region 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

In some embodiments, article 100 may include an outer shell 110 and an inner liner 130. Outer shell 110 and inner liner 130 may be removably associated with one another. In an exemplary embodiment, outer shell 110 may be configured to receive inner liner 130 within an interior of outer shell 110 to form article 100. With this configuration, inner liner 130 may be inserted and removed from outer shell 110.

In some embodiments, outer shell 110 may include an upper 112 and sole structure 140. Sole structure 140 is secured to upper 112 and extends between the foot and the ground when article 100 is worn. In different embodiments, sole structure 140 may include different components. For example, sole structure 140 may include an outsole, a midsole, and/or an insole. In some cases, one or more of these components may be optional.

In some embodiments, sole structure 140 may be configured to provide traction for article 100. In addition to providing traction, sole structure 140 may attenuate ground reaction forces when compressed between the foot and the ground during walking, running or other ambulatory activities. The configuration of sole structure 140 may vary significantly in different embodiments to include a variety of conventional or non-conventional structures. In some cases, the configuration of sole structure 140 may be configured according to one or more types of ground surfaces on which sole structure 140 may be used. Examples of ground surfaces include, but are not limited to: natural turf, synthetic turf, dirt, as well as other surfaces.

In embodiments where article of footwear 100 is a snowboard boot, sole structure 140 may include provisions for interacting with a snowboard. For example, in some cases, sole structure 140 may include features for receiving, and fastening to, bindings on a snowboard. Furthermore, sole structure 140 may include traction members to enhance grip between article 100 and a snowboard. For purposes of clarity, sole structure 140 is shown without any particular features for associating with a snowboard, but it will be understood that in different embodiments any such provisions known in the art may be used.

In some embodiments, upper 112 of outer shell 110 may be configured to receive inner liner 130 including a foot of a wearer of article 100. Generally, upper 112 may be any type of upper. In particular, upper 112 could have any design, shape, size and/or color. For example, in embodiments where article 100 is a basketball shoe, upper 112 could be a high top upper that is shaped to provide high support on an ankle. In embodiments where article 100 is a running shoe, upper 112 could be a low top upper. In an exemplary embodiment, upper 112 has the shape of a boot upper that completely covers a foot and provides additional coverage at an ankle.

In an exemplary embodiment, upper 112 of outer shell 110 may be provided with a lower portion 114 and an upper portion 116. In some cases, lower portion 114 may be associated with, and configured to receive, the toes, arch and heel of a foot. Upper portion 116 may extend upwards from lower portion 114. In some cases, upper portion 116 may be associated with an ankle of a foot. In an exemplary embodiment, upper portion 116 may be a cuff portion for upper 112 of outer shell 110.

Upper 112, including both lower portion 114 and upper portion 116, may define a void in article 100 for receiving and securing inner liner 130 including a foot relative to sole structure 140. In particular, the void is shaped to accommodate inner liner 130 including a foot and extends along the lateral side of the foot, along the medial side of the foot, over the foot and under the foot. In some cases, outer shell 110 may be provided with an entry hole 118 that provides access to the void within upper 112. In an exemplary embodiment, entry hole 118 may be provided at top end of upper portion 116.

Article 100 may include lacing system 120 for purposes of adjusting upper 112. In some cases, lacing system 120 may extend from forefoot region 10 through midfoot region 12 of article 100. Furthermore, in some cases, lacing system 120 may extend through lower portion 114 and upper portion 116 of upper 112. In particular, lacing system 120 may be associated with lacing region 122 that is disposed between lateral side 16 and medial side 18 of upper 112.

In some embodiments, upper 112 may include a tongue 123 that extends through lacing region 122 of upper 112. In some cases, tongue 123 may be integrally formed with upper 112. In other cases, however, tongue 123 may be a separate component from upper 112 and may be attached to upper 112 using conventional methods such as stitching or adhesives. In some cases, tongue 123 may include padding or other cushioning material to provide comfort to a foot of a wearer of article 100.

In some embodiments, lacing system 120 may include lacing member 124. The term "lacing member", as used throughout this detailed discussion, refers to any type of lace that may be used with an article of footwear. Generally, the size, including cross sectional shape and length, of lacing member 124 may be varied. Also, lacing member 124 may be made of any material, including, but not limited to: various types of natural and/or synthetic fibers, as well as other types of materials that may be used as laces. Furthermore it should be understood that although a single lacing member is shown in this preferred embodiment, other embodiments may incorporate more than one lace.

In some embodiments, lacing system 120 may include provisions for securing lacing member 124 to various portions of upper 112 and outer shell. In some embodiments, lacing system 120 may include lace receiving members configured to receive portions of lacing member 124. In other words, these lace receiving members may function in a similar manner to traditional eyelets. In different embodiments, different types of lace receiving members may be used. Examples of different lace receiving members include but are not limited to: eyelets, hooks, lace loops, as well as other types of lace receiving members.

In some embodiments, lacing system 120 may include lace hook members 126. In particular, lace hook members 126 may include a plurality of lace hook members disposed on either side of lacing gap 122 along a medial edge and a lateral edge of upper portion 116 of upper 112 on outer shell 110. In an exemplary embodiment, lace hook members 126 may be traditional types of lace hooks. Generally, lace hooks of lace hook members 126 may have any shape that is configured to receive lacing member 124 for the purposes of tightening the medial edge and the lateral edge on opposite sides of lacing gap 122 on upper portion 116 of upper 112. It will be understood that in other embodiments, different types of lace receiving members could be used in place of lace hooks.

In some embodiments, lacing system 120 may further include lace loop members 128. In particular, lace loop members 128 may include a plurality of lace loop members disposed on either side of lacing gap 122 along a medial edge and a lateral edge of lower portion 114 of upper 112 on outer shell 110. In an exemplary embodiment, lace loops of lace loop members 128 may have any shape that is configured to receive lacing member 124 for the purposes of tightening the medial edge and lateral edge on opposite sides of lacing gap 122 on lower portion 114 of upper 112. It will be understood that in other embodiments, different types of lace receiving members could be used in place of lace loops.

In different embodiments, the materials used for the various components of article 100 may vary. For example, sole structure 140 may be made from any suitable material, including, but not limited to: elastomers, siloxanes, natural rubber, other synthetic rubbers, aluminum, steel, natural leather, synthetic leather, or plastics. In some cases, the materials used for making sole structure 140 may be selected to accomplish stability and cushioning for a foot undergoing forces typically associated with snowboarding.

Also, outer shell 110 and/or upper 112 may be made from any suitable material. Examples of materials for outer shell 110 and/or upper 112 include, but are not limited to: nylon, natural leather, synthetic leather, natural rubber or synthetic rubber. In some cases, outer shell 110 and/or upper 112 may be made of any suitable knitted, woven or non-woven material. In an exemplary embodiment, outer shell 110 and/or upper 112 may be made of a combination of layers. For example, in some cases, outer shell 110 and/or upper 112 may be provided with an outer layer made of synthetic leather, which can enhance the durability of upper 112. The outer layer can be reinforced on an interior side of upper 112 by an inner layer made of, for example, a synthetic fabric that provides padding and/or insulation.

In an exemplary embodiment, article 100 may include inner liner 130 that is configured to be inserted into entry hole 118 within the interior of outer shell 110 to fill the void defined by upper 112. Inner liner 130 may be made from any suitable material. Examples of materials for inner liner 130 include, but are not limited to: nylon, cotton, polyester, natural and/or synthetic fibers or blends, as well as any of the materials used for upper 112, including natural leather, synthetic leather, natural rubber, and/or synthetic rubber. In some cases, inner liner 130 may be made of any suitable knitted, woven or non-woven material. In an exemplary embodiment, inner liner 130 may be made of a combination of materials. In some cases, inner liner 130 may be made of a material that is configured to provide comfort to a foot of a wearer when disposed within article 100. In an exemplary embodiment, inner liner 130 may be made of a combination of layers. For example, in some cases, inner liner 130 may be provided with an outer layer that is configured to be disposed along the inside of outer shell 110 and an inner layer that is configured to be disposed within the interior of inner liner 130.

Referring now to FIG. 2, an exploded view of article 100, including outer shell 110 and inner liner 130 is illustrated. In this embodiment, inner liner 130 may be seen removably disposed from within the interior of outer shell 110. As discussed above, in some embodiments, inner liner 130 may be inserted and withdrawn from outer shell 110 through entry hole 118.

In an exemplary embodiment, inner liner 130 may have a corresponding shape as outer shell 110. For example, in cases where outer shell 110 and/or upper 112 is configured to be a low top upper, inner liner 130 may have a similar shape. In this embodiment, where outer shell 110 and/or upper 112 is a boot, inner liner 130 may have a corresponding shape. In an exemplary embodiment, inner liner 130 may be provided with a lower liner portion 200 and an upper liner portion 202. In some cases, lower liner portion 200 may be associated with, and configured to receive, the toes, arch and heel of a foot. Upper liner portion 202 may extend upwards from lower liner portion 200. In some cases, upper liner portion 202 may be associated with an ankle of a foot. In an exemplary embodiment, upper liner portion 202 may be a cuff portion for inner liner 130.

In an exemplary embodiment, inner liner 130 may include a bottom 204 disposed on lower liner portion 200. Bottom 204 of inner liner 130 may be configured to rest along the bottom interior of outer shell 110 inside of upper 112. In some cases, bottom 204 may be made of a different material from the rest of inner liner 130 that is configured to provide traction or friction with the interior of outer shell 110. In other cases, bottom 204 may be treated with an applied coating or material to increase the traction or friction with the interior of outer shell 110. In one embodiment, bottom 204 may include a rubberized coating.

In some embodiments, inner liner 130 may include a tongue 203 that extends through upper liner portion 202 and into a portion of lower liner portion 200. In an exemplary embodiment, tongue 203 may correspond approximately to lacing region 122 of upper 112. In some cases, tongue 203 may be integrally formed with inner liner 130. In other cases, however, tongue 203 may be a separate component from inner liner 130 and may be attached to inner liner 130 using conventional methods such as stitching or adhesives. In some cases, tongue 203 may include padding or other cushioning material to provide comfort to a foot of a wearer of article 100.

In some embodiments, inner liner 130 may be provided with a fastening member 210. Fastening member 210 may be a strap or other mechanism that is configured to tighten upper liner portion 202 of inner liner 130 on a foot of a wearer. In an exemplary embodiment, fastening member 210 may be secured to inner liner 130 on a first side and may be adjustably secured to an anchor 212 disposed on the exterior of inner liner 130 on a second side to allow fastening member 210 to be drawn tight. In one embodiment, fastening member 210 may include hook and loop fasteners to hold fastening member 210 in a closed position on inner liner 130. In other embodiments, other tightening or fastening mechanisms may be used to tighten inner liner 130 around a foot of a wearer.

Figure 3:
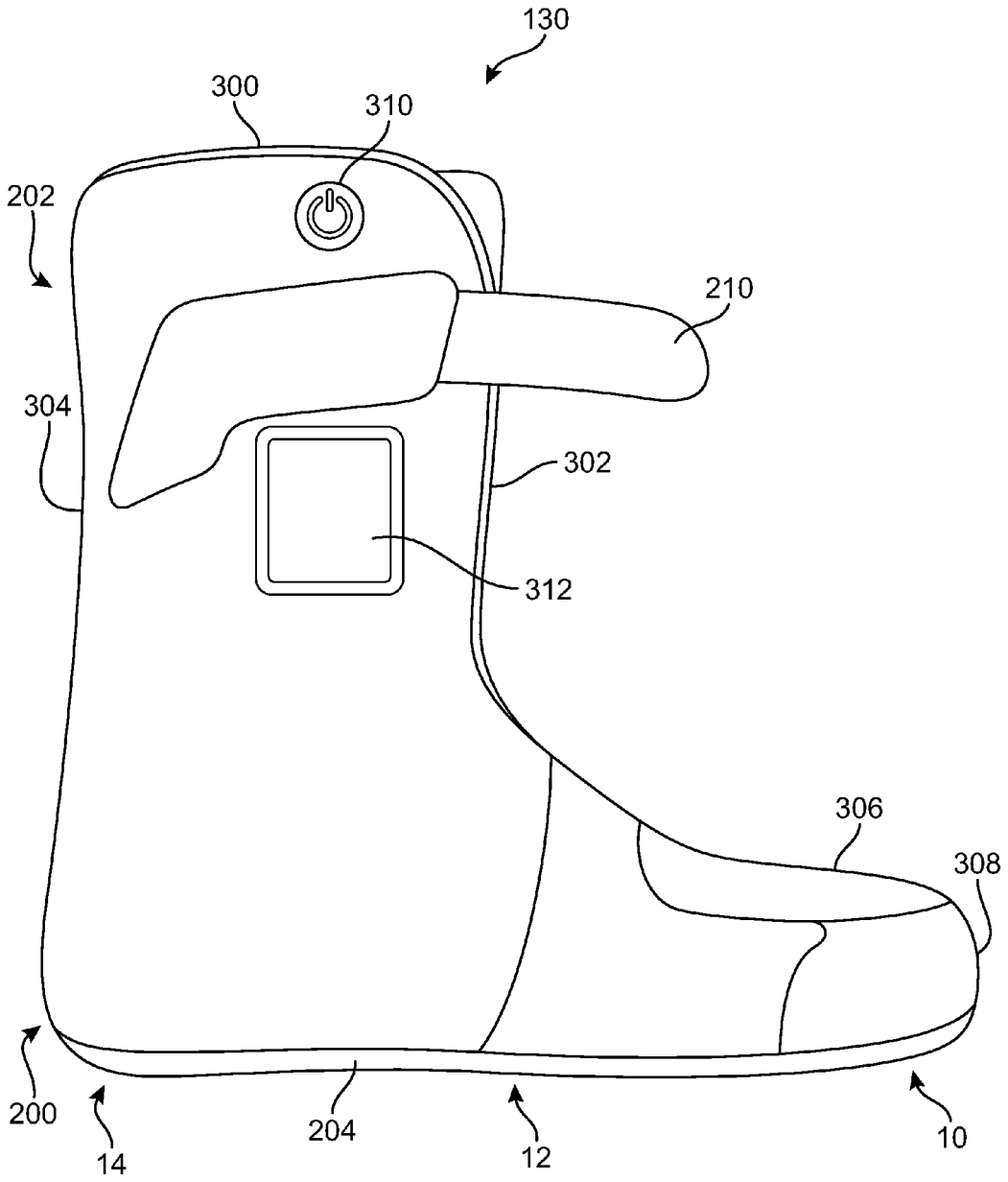
FIG. 3 is a lateral side view of an exemplary embodiment of an inner liner for an article of footwear.

FIG. 3 illustrates a lateral side view of inner liner 130. In an exemplary embodiment, inner liner 130 may be configured for insertion in outer shell 110 to form a boot. In this embodiment, inner liner 130 includes a top edge 300 of upper liner portion 202. Top edge 300 is disposed along the top of inner liner 130 and extends from lateral side 16 to medial side 18. Upper liner portion 202 also includes a front edge 302. Front edge 302 extends from top edge 300 of upper liner portion 202 downwards towards lower liner portion 200 along the front of inner liner 130. In an exemplary embodiment, front edge 302 may include a first front edge disposed on lateral side 16 and a second front edge disposed on medial side 18, disposed on either side of tongue 203. In an exemplary embodiment, top edge 300 and front edge 302 together may be associated with a cuff portion of upper liner 202.

In some embodiments, a rear portion 304 may be disposed along the back of inner liner 130 opposite front edge 302 extending through upper liner portion 202 and lower liner portion 200. Rear portion 304 may be associated with a heel and achilles tendon of a foot of a wearer. In an exemplary embodiment, lower liner portion 200 may include a top forefoot portion 306 extending along a top of lower liner portion 200. Top forefoot portion 306 may extend over the top or instep of a foot and extend towards the toe end of inner liner 130. In an exemplary embodiment, the toe end of inner liner 130 may include a toe cap perimeter 308 that extends along the perimeter of the toe end of forefoot region 10 of lower liner portion 200. Toe cap perimeter 308 may extend vertically between top forefoot portion 306 and bottom 204 of inner liner 130. In some embodiments, toe cap perimeter 308 may extend approximately along an outer edge of forefoot region 10 continuously from lateral side 16 to medial side 18.

In some embodiments, inner liner 130 may be configured with components to provide heating or warming to the interior of inner liner 130. In an exemplary embodiment, inner liner 130 may include a heating system with one or more heating elements that are configured to warm the toes and foot of a wearer when disposed within inner liner 130. With this arrangement, inner liner 130, including one or more heating elements, may be disposed within outer shell 110 to provide a heated boot that may worn by a wearer in cold weather conditions while providing heat and/or warmth to the wearer's toes and feet.

In this embodiment, lateral side 16 of inner liner 130 includes a control mechanism 310 that may be associated with one or more components of a heating system. Control mechanism 310 may be associated with a power button, switch or other control device, including an electronic control unit (ECU) associated with a computer or CPU, disposed on an outer surface of upper liner portion 202. In an exemplary embodiment, control mechanism 310 may be disposed adjacent to top edge 300 of the cuff of upper liner portion 202. With this arrangement, control mechanism 310 may be easily depressed or accessed by a wearer of article 100.

In some embodiments, inner liner 130 may further include an embossed battery area 312. In an exemplary embodiment, embossed battery area 312 extends outward from the outer surface of upper liner portion 202 of inner liner 130 and is configured to correspond to the shape of a battery or other power source that may be disposed within a compartment between the layers of the cuff of upper liner portion 202. In one embodiment, embossed battery area 312 may have an approximately rectangular shape corresponding to a rectangular battery or power source. In other embodiments, however, embossed battery area 312 may have a different shape corresponding to the shape of a power source or battery.

In this embodiment, embossed battery area 312 may be disposed on upper liner portion 202 of inner liner 130 beneath control mechanism 310. In some embodiments, fastening member 210 may be disposed on upper liner portion 202 between control mechanism 310 and embossed battery area 312. In other embodiments, the location of embossed battery area 312 on upper liner portion 202 may be varied.

Figure 4:
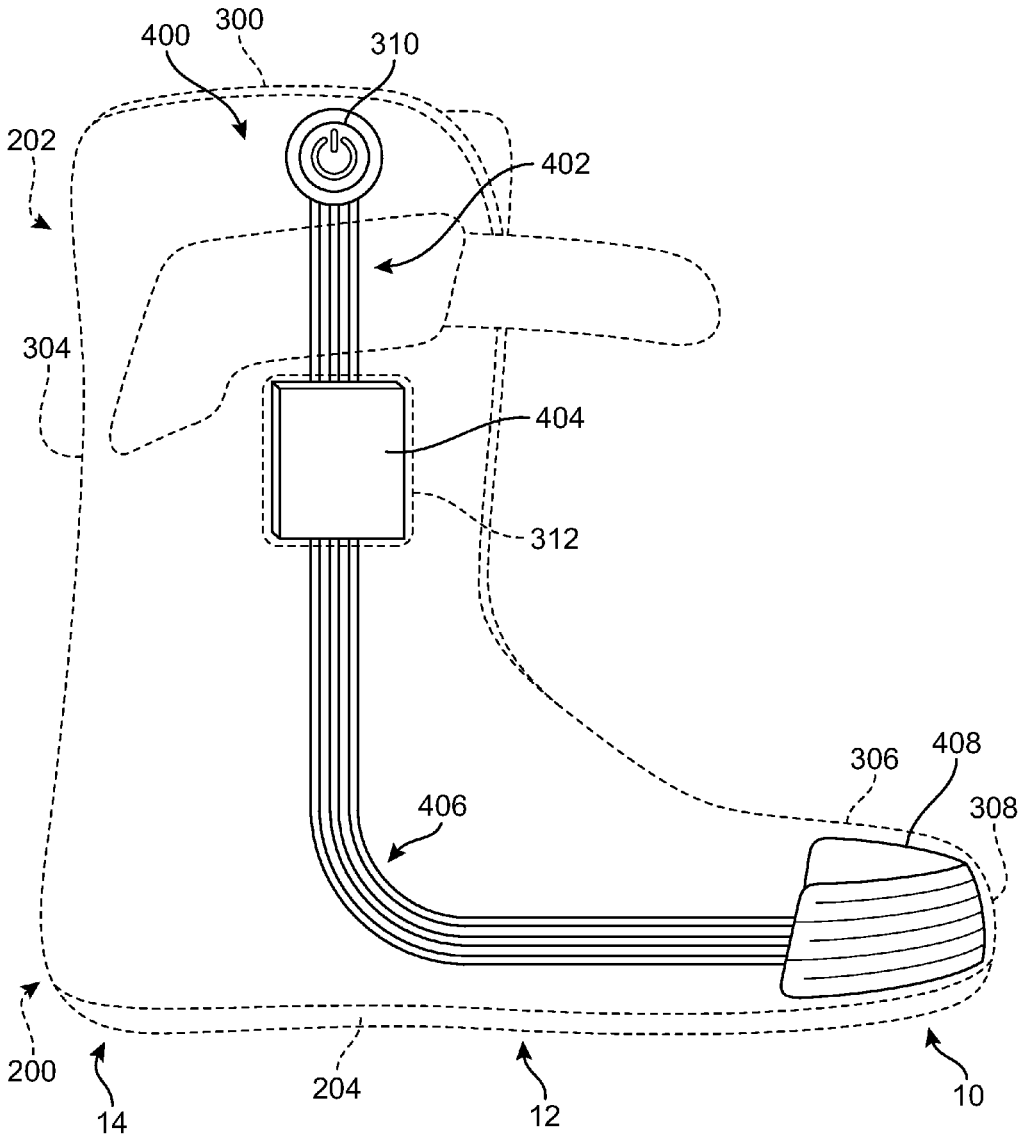
FIG. 4 is a lateral side view of an exemplary embodiment of an inner liner for an article of footwear including a heating system with the liner illustrated in phantom.

FIG. 4 illustrates a heating system 400 disposed within inner liner 130. In some embodiments, heating system 400 may include one or more electronic components that are integrated within inner liner 130. In an exemplary embodiment, heating system 400 may be completely disposed within inner liner 130 so that heating system 400 is removably associated with article 100 when inner liner 130 is removed from within the interior of outer shell 110. With this arrangement, various electronic components of heating system 400 do not require an electrical connection between inner liner 130 and outer shell 110.

In addition, by providing article 100 with heating system 400 disposed within inner liner 130 so that heating system 400 is not connected with outer shell 110, inner liner 130 with heating system 400 may be completely removed from outer shell 110. In an exemplary embodiment, heating system 400 may be operated while outside of outer shell 110. With this arrangement, heating system 400 may be used for drying inner liner 130 while removed from outer shell 110. In some embodiments, heating system 400 may be provided with a setting that corresponds to a drying function.

In some embodiments, heating system 400 may include control mechanism 310, discussed above, for controlling various functions associated with heating system 400. In an exemplary embodiment, control mechanism 310 may be configured to turn power on and off to heating system 400. In some embodiments, control mechanism 310 may be configured to control other functions associated with heating system 400, including changing between one or more power or heating settings. For example, control mechanism 310 may be configured to switch heating system 400 between an off state, a low power state, and a high power state. In other embodiments, additional levels of power or heating may be controlled using control mechanism 310.

In an exemplary embodiment, power for the components associated with heating system 400 may be provided by a power source 404. In one embodiment, power source 404 may be a rechargeable battery that is configured to supply electrical power to the various components of heating system 400. In other embodiments, power source 404 may be any other known kind of battery or other source of electrical power. In some embodiments, heating system 400 may further include components configured to transmit signals and/or power to the various components of heating system 400. In an exemplary embodiment, heating system 400 may include wires 402 connecting control mechanism 310 and power source 404. Similarly, wires 406 may connect power source 404 and/or control mechanism 310 with additional components of heating system 400, including a heating element.

It should be understood that the exact location and electronic components illustrated in FIG. 4 that are associated with heating system 400 are exemplary and in other embodiments, heating system 400 may have a different configuration, including additional or fewer components. In some embodiments, heating system 400 may include a thermistor or thermostat (not shown) for controlling and/or determining the temperature associated with heating system 400 or the interior of article 100. Control mechanism 310 may be configured to use information from the thermistor or thermostat to control the operation of heating system 400, including the determination of power or heating levels or settings. Heating system 400 may further include other known components that are associated with a heating system for an article of footwear, including various wires, connections, ports, circuitry, and controls that are known in the art.

Figure 5:
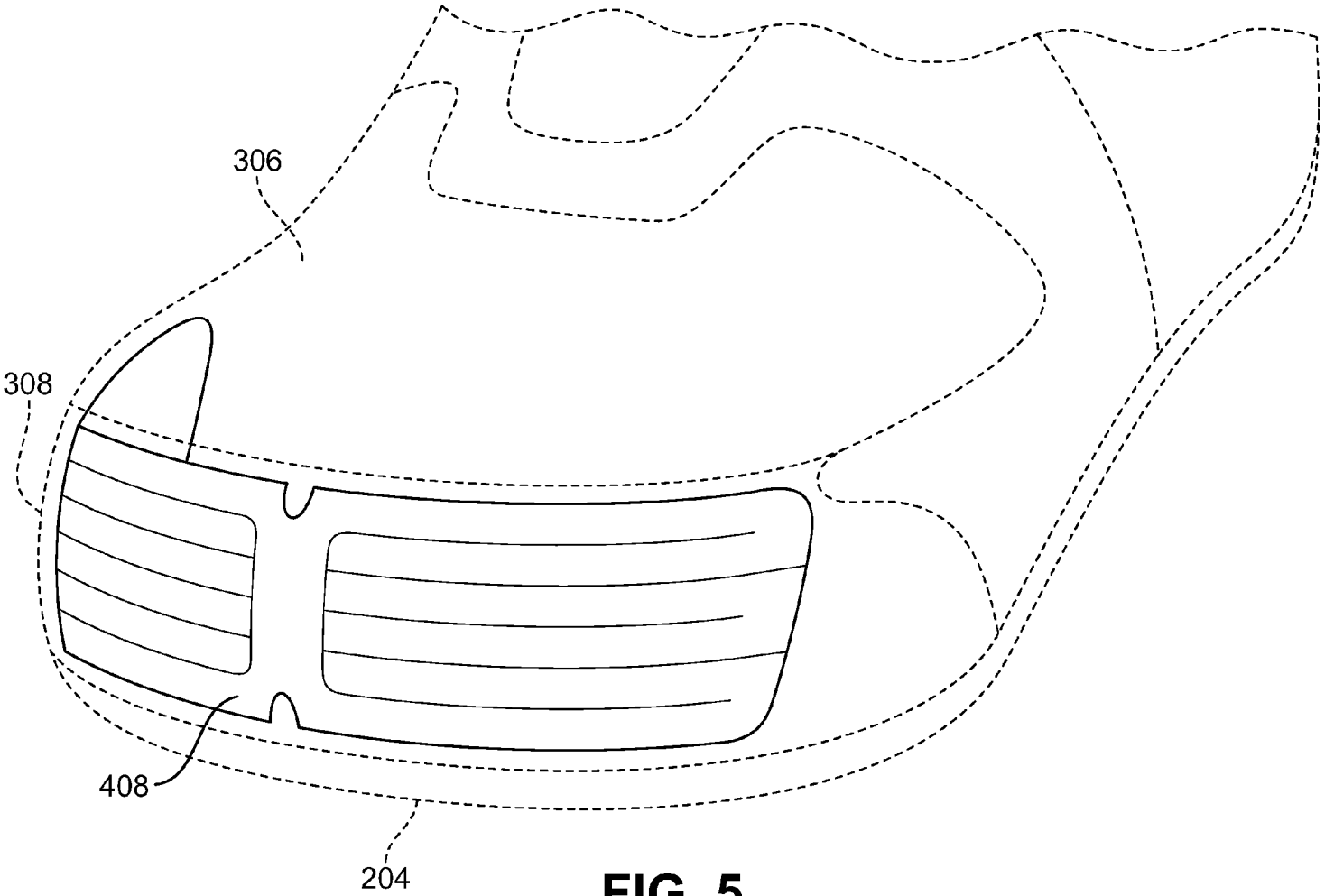
FIG. 5 is an enlarged view of an exemplary embodiment of a forefoot region of an inner liner for an article of footwear including a toe cap heating element with the liner illustrated in phantom.

In some embodiments, heating system 400 may include a toe cap heating element 408. Toe cap heating element 408 may be connected to power source 404 and/or control mechanism 310 via wires 406. In an exemplary embodiment, toe cap heating element 408 may be disposed along the toe cap perimeter 308 of inner liner 130. As shown in FIG. 5, toe cap heating element 408 may be disposed along an interior of forefoot region 10 of inner liner 130 along the perimeter of the toe end of lower liner portion 200. In an exemplary embodiment, toe cap heating element 408 may extend vertically between top forefoot portion 306 and bottom 204 of inner liner 130. In one embodiment, toe cap heating element 408 extends only along toe cap perimeter 308 and does not extend over onto top forefoot portion 306 and/or under onto bottom 204. In some embodiments, toe cap heating element 408 may extend approximately along an outer edge of forefoot region 10 continuously from lateral side 16 to medial side 18. With this arrangement, toe cap heating element 408 may provide heat and/or warmth to the toes and foot of a wearer when disposed within inner liner 130.

Figure 6:
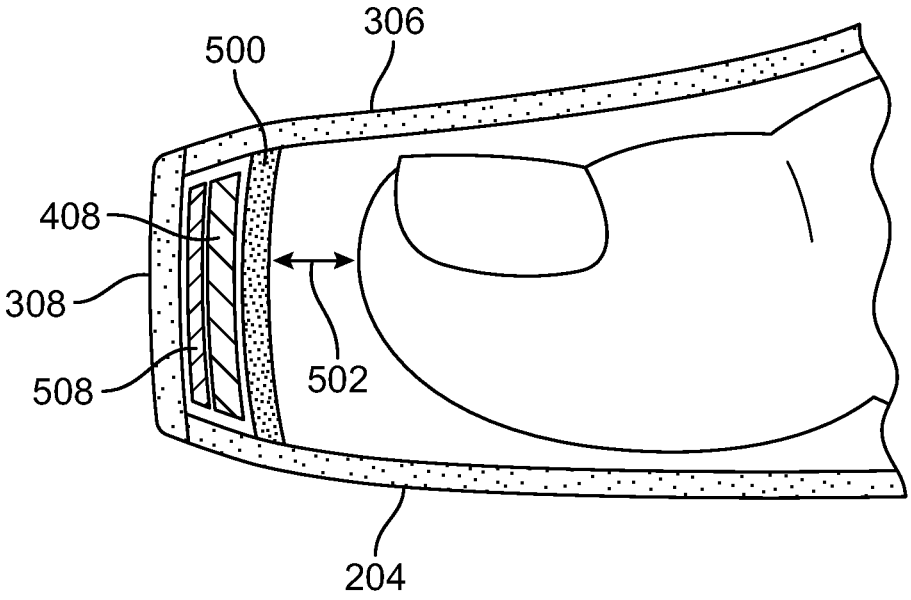
FIG. 6 is an enlarged cross-section of an exemplary embodiment of a forefoot region of an inner liner for an article of footwear including a toe cap heating element.

FIG. 6 illustrates an enlarged cross-section of the toe end of inner liner 130 to show the approximate placement of toe cap heating element 408 within inner liner 130. As shown in this embodiment, toe cap heating element 408 may be arranged approximately vertically along toe cap perimeter 308 so that toe cap heating element 408 extends between top forefoot portion 306 and bottom 204. With this arrangement, toe cap eating element 408 may not extend over the top of the foot or beneath the foot when disposed within the interior of inner liner 130. In one aspect, the outermost front tip portion of the forefoot region is disposed adjacent the toe cap perimeter 308 and extends vertically between the bottom of the lower liner 204 and the top forefoot portion 306, wherein the outermost front tip portion comprises a gap, the gap is positioned between the toe cap perimeter and an interior liner layer 500; wherein the heating element 408 is designed to be positioned within the gap; a reflective film 508 is disposed along the toe cap perimeter and is designed to be positioned within the gap.

In addition, in some embodiments, an interior liner layer 500 may be disposed within the interior of inner liner 130 at the toe end to provide a barrier of fabric or other material between toe cap heating element 408 and a toe of a wearer. With this arrangement, the toes of a foot of a wearer may not be in direct contact with toe cap heating element 408. For example, a gap 502 may be provided between the toes of a wearer and interior liner layer 500 to allow heated air to circulate within the interior of inner liner 130.

In an exemplary embodiment, interior liner layer 500 may be a heat-permeable fabric or mesh that allows radiated heat from toe cap heating element 408 to pass through interior liner layer 500 to the interior of inner liner 130 and warm the toes and foot of a wearer. In addition, while in the embodiment of FIG. 6 interior liner layer 500 is shown only disposed along toe cap perimeter 308, in other embodiments, interior liner layer 500 may extend over substantially the entirety of the interior of inner liner 130 to provide a barrier layer for a foot of a wearer of article 100.

In some embodiments, the toe end of inner liner 130 may be provided with a reflective film 508. In an exemplary embodiment, reflective film 508 may be disposed between toe cap heating element 408 and toe cap perimeter 308. Reflective film 508 may be made of a material that is configured to reflect heat provided from toe cap heating element 408 towards the interior of inner liner 130. Suitable materials for reflective film 508 may include, but are not limited to: metallic or semi-metallic materials, metallic and metallized polymer films, and other suitable materials for reflecting heat. In an exemplary embodiment, reflective film 508 may be provided to prevent or reduce heat from toe cap heating element 408 from being radiated outside of the interior of inner liner 130. With this arrangement, the toes of a wearer may be further warmed or heated by the reflected heat from reflective film 508. In other embodiments, reflective film 508 may be disposed on other locations on inner liner 130, including on an exterior portion of inner liner 130, or on locations on outer shell 110, including an interior of outer shell 110 corresponding to the toe end of inner liner 130. In still other embodiments, reflective film 508 is optional and may be omitted.

Figure 7:
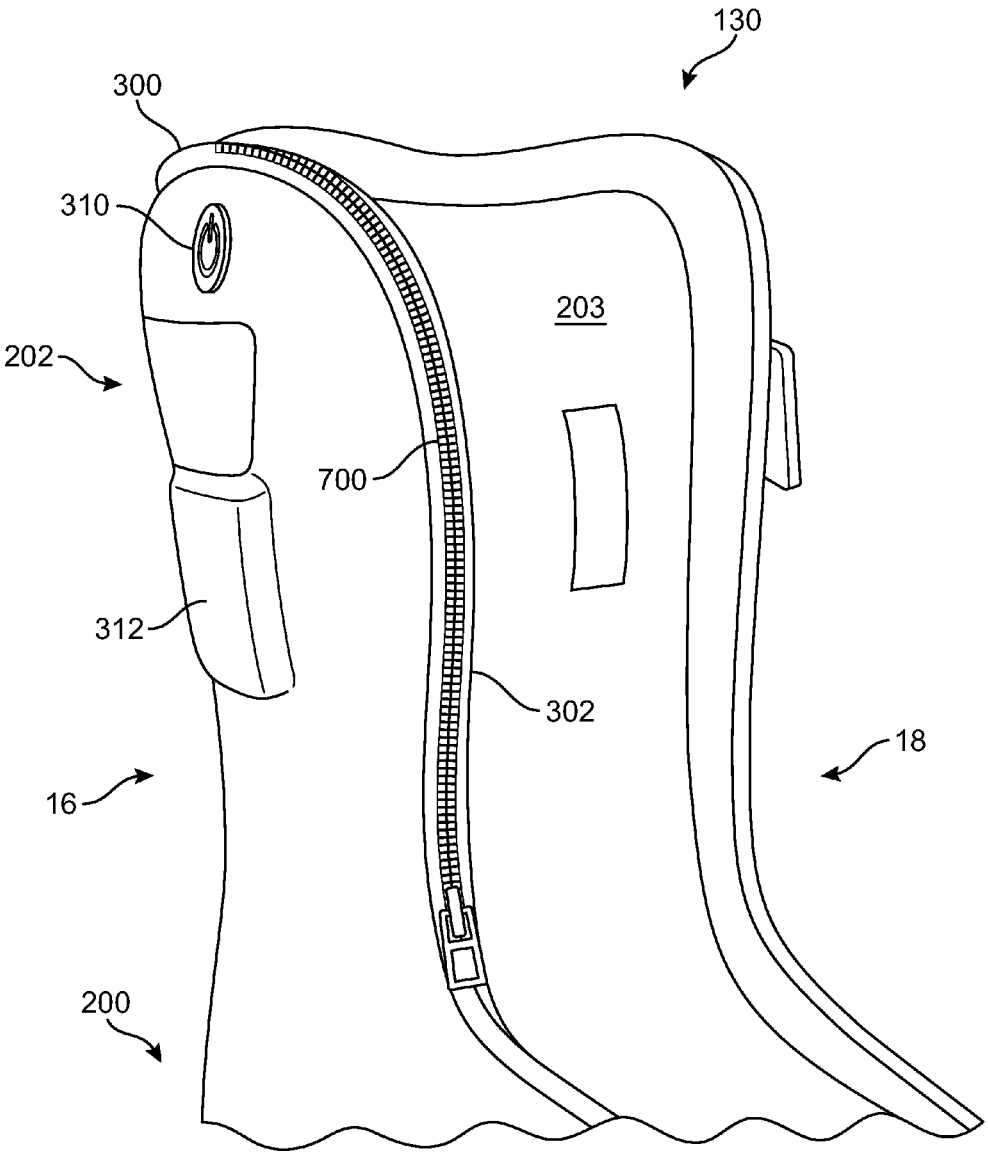
FIG. 7 is an enlarged view of an exemplary embodiment of an upper liner portion of an inner liner for an article of footwear illustrating a closed position of a battery compartment area.
Figure 8:
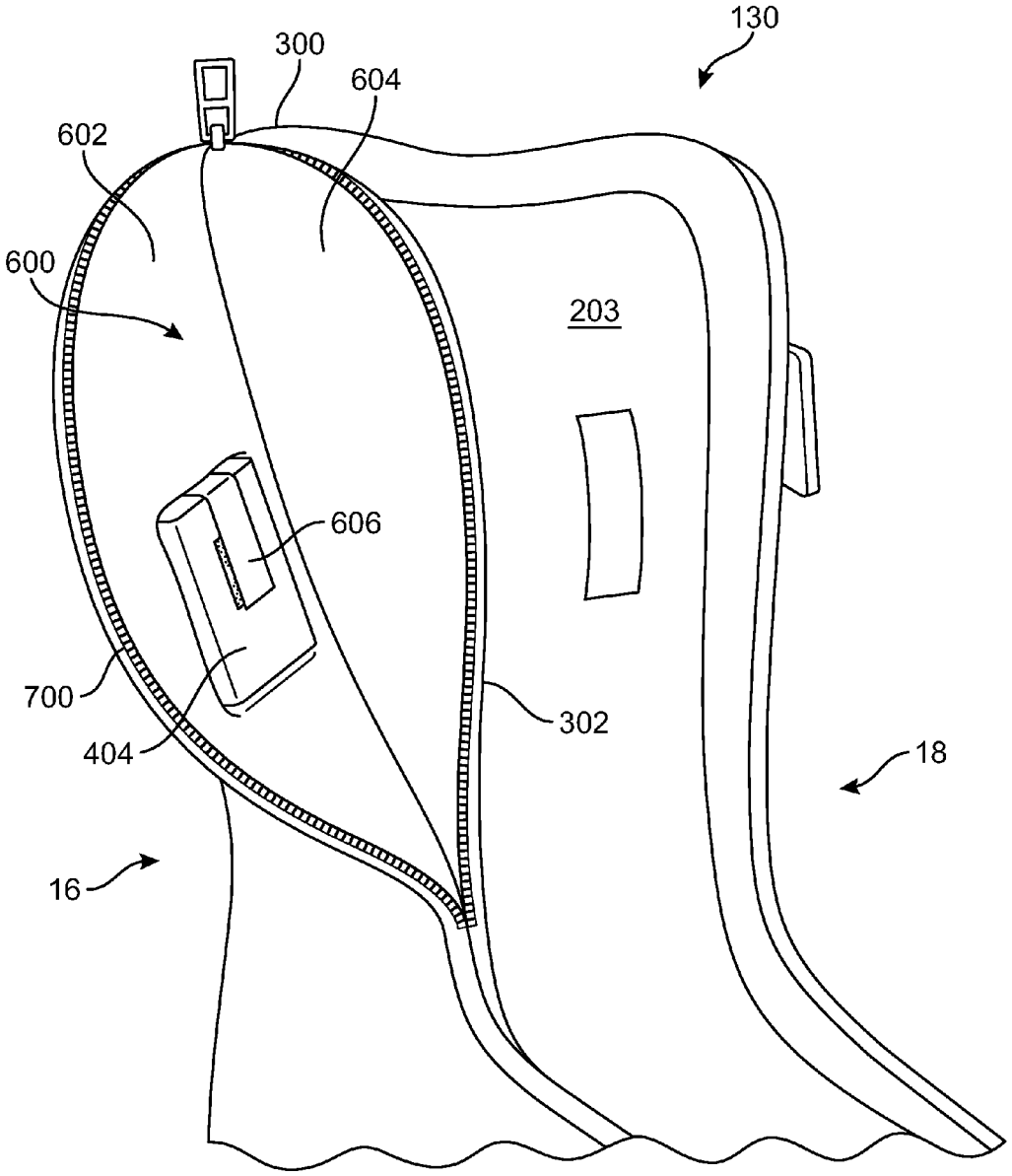
FIG. 8 is an enlarged view of an exemplary embodiment of an upper liner portion of an inner liner for an article of footwear illustrating an open position of a battery compartment area.

In some embodiments, inner liner 130 may be configured to provide access to components of heating system 400. FIGS. 7 and 8 illustrate an arrangement along a cuff of upper liner portion 202 of inner liner 130 that provides access to a battery compartment area between inner and outer layers of inner liner 130. Referring now to FIG. 7, the cuff of upper liner portion 202 of inner liner 130 is illustrated. In this embodiment, a zipper 700 may be disposed on the cuff running from top edge 300 and extending downwards along front edge 302 on lateral side 16 of upper liner portion 202. In an exemplary embodiment, zipper 700 may be moved between an opened position and a closed position to allow access to an interior of a battery compartment area that includes power source 404. As shown in FIG. 7, power source 404 may fitted within embossed battery area 312 from the interior of a battery compartment area that is accessed with zipper 700. In this embodiment, zipper 700 is shown in the closed position.

FIG. 8 illustrates zipper 700 in the opened position to allow access to the interior of battery compartment area 600. In some embodiments, battery compartment area 600 may be disposed between an outer layer 602 and an inner layer 604 of the cuff of inner liner 130. Together, outer layer 602 and inner layer 604 may form battery compartment area 600 as a pocket. In an exemplary embodiment, one or more components associated with heating system 400 may be accessed from within battery compartment area 600. In one embodiment, power source 404 may be accessed from within the interior of battery compartment area 600. In an exemplary embodiment, power source 404 may be disposed within a recess corresponding to embossed battery area 312 on the outer surface of outer layer 602. In one embodiment, a securing member 606 may be provided to secure power source 404 within the recess and hold power source 404 in place within battery compartment area 600. In an exemplary embodiment, securing member 606 may be provided with a hook and loop fastener to removably associate with a corresponding hook and loop fastener on power source 404. In other embodiments, however, other removable securing mechanisms, including, but not limited to snaps, buttons, or other known devices, may be used to hold power source 404 in place. With this arrangement, power source 404 may be easily and readily accessed and removed from inner liner 130 for replacement and/or recharging by using zipper 700 to gain access to battery compartment area 600.

In addition, in other embodiments, other mechanisms than zipper 700 may be used to join outer layer 602 and inner layer 604 so as to open and close battery compartment area 600. For example, in some embodiments, hook and loop fasteners may be disposed along the edges of outer layer 602 and inner layer 604 to allow battery compartment area 600 to be opened and closed. Other known fastening mechanisms may be used to open and close battery compartment area 600. In addition, while battery compartment area 600 has been described as allowing access to power source 404, it should be understood that other components of heating system 400 may also be accessed from within the interior of battery compartment area 600, including, but not limited to: control mechanism 310, and any one or more of wires 402 and wires 406, as well as other components.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an outer shell, the outer shell including an upper and a sole structure;

an inner liner, the inner liner being a separate component designed to be inserted and also removed from within an interior of the outer shell;

the inner liner further comprising a heating system, the heating system including a power source and a heating element;

wherein the heating system is disposed within the inner liner;

the inner liner having an upper liner portion and a lower liner portion, wherein the upper liner portion includes a cuff;

the lower liner portion having a forefoot region, a heel region opposite the forefoot region, a midfoot region disposed between the forefoot region and the heel region, and an outermost front tip portion of the forefoot region;

wherein the outermost front tip portion of the forefoot region, is disposed adjacent a toe cap perimeter and extends vertically between a bottom of the inner liner and a top portion of the forefoot region, wherein the outermost front tip portion comprises a gap, the gap is positioned between the toe cap perimeter and an interior liner layer;

wherein the forefoot region having a lateral side and a medial side;

wherein the cuff includes a battery compartment area disposed in between an outer layer of the inner liner and an inner layer of the inner liner, the battery compartment area being configured to receive the power source of the heating system; and wherein the heating element is a toe cap heating element that is designed to be positioned only within the gap, the heating element having a rectangular and arcuate geometry including a vertical portion extending vertically between the bottom of the inner liner and the top portion of the forefoot region and a horizontal portion extending in a curve from the lateral side to the medial side of the forefoot region.

2. The article of footwear according to claim 1, wherein the battery compartment area is disposed along a top edge of the upper liner portion of the inner liner and extends downward along a front edge of the upper liner portion.

3. The article of footwear according to claim 1, wherein the battery compartment area comprises a fastening mechanism that is configured to join the outer layer with the inner layer.

4. The article of footwear according to claim 3, wherein the fastening mechanism is a zipper.

5. The article of footwear according to claim 1, wherein the upper liner portion of the inner liner further comprises an embossed battery area; and wherein the embossed battery area extends outwards from an outer surface of the upper liner portion.

6. The article of footwear according to claim 5, wherein the battery compartment area includes a recess disposed along the outer layer that corresponds to the embossed battery area.

7. The article of footwear according to claim 6, further comprising a securing member within the battery compartment area that is configured to hold the power source within the recess.

8. An article of footwear comprising:

an outer shell, the outer shell including an upper and a sole structure;

an inner liner, the inner liner being a separate component designed to be inserted and also removed from within an interior of the outer shell;

the inner liner further comprising a heating system, the heating system including a power source and a heating element;

wherein the heating system is disposed within the inner liner;

the inner liner having an upper liner portion and a lower liner portion;

the lower liner portion including a bottom disposed along an underside of the inner liner, the bottom being configured to rest along a bottom of the interior of the outer shell when the inner liner is inserted within the outer shell;

the lower liner portion further comprising a top forefoot portion disposed along a top of the inner liner in a forefoot region, a toe cap perimeter disposed along an outer edge of a toe end of the forefoot region, the toe cap perimeter extending between the bottom of the lower liner and the top forefoot portion, and an outermost front tip portion of the forefoot region;

wherein the outermost front tip portion of the forefoot region is disposed adjacent the toe cap perimeter and extends vertically between the bottom of the lower liner and the top forefoot portion, wherein the outermost front tip portion comprises a gap, the gap is positioned between the toe cap perimeter and an interior liner layer;

wherein the heating element is designed to be positioned within the gap;

a reflective film is disposed along the toe cap perimeter and is designed to be positioned within the gap;

the interior liner layer is disposed along the toe cap perimeter; and wherein the heating element is disposed between the reflective film and the interior liner layer, and the reflective film is disposed between the heating element and the toe cap perimeter.

9. The article of footwear according to claim 8, wherein the heating system is entirely integrated within the inner liner.

10. The article of footwear according to claim 8, wherein the heating system further comprises a control mechanism; and wherein the control mechanism is connected to at least one of the power source and the heating element.

11. The article of footwear according to claim 10, wherein the control mechanism is disposed on the upper liner portion adjacent to a top edge of the inner liner.

12. The article of footwear according to claim 10, wherein the upper liner portion further comprises a battery compartment area configured to receive the power source; and wherein the battery compartment area is disposed along a top edge of the upper liner portion of the inner liner and extends downward along a front edge of the upper liner portion.

13. The article of footwear according to claim 8, wherein the heating element extends between a lateral side and a medial side along the toe cap perimeter; and wherein the heating element is disposed between the top forefoot portion of the lower liner portion and the bottom of the lower liner portion.

14. The article of footwear according to claim 13, wherein the heating element corresponds in size and shape to the reflective film.

15. An article of footwear comprising:

an outer shell, the outer shell including an upper and a sole structure;

an inner liner, the inner liner being a separate component designed to be inserted and also removed from within an interior of the outer shell;

the inner liner having an outer layer and an inner layer;

the inner liner further comprising a heating system, the heating system including a power source and a heating element;

wherein the heating system is disposed between the outer layer and the inner layer of the inner liner;

the inner liner having an upper liner portion and a lower liner portion, wherein the upper liner portion includes a cuff disposed along a top edge of the upper liner portion and extending downwards along a front edge of the upper liner portion, and the lower liner portion having a forefoot region, a heel region opposite the forefoot region, a midfoot region disposed between the forefoot region and the heel region;

wherein the heating element is positioned along only an outermost front tip portion of the forefoot region of the lower liner portion; wherein the outermost front tip portion of the forefoot region is disposed adjacent a toe cap perimeter and extends vertically between a bottom of the inner liner and a top portion of the forefoot region, wherein the outermost front tip portion comprises a gap, the heating element is designed to be positioned within the gap;

wherein the cuff includes a battery compartment area disposed in between the outer layer of the inner liner and the inner layer of the inner liner, the battery compartment area being configured to receive the power source of the heating system; and wherein the battery compartment area comprises a fastening mechanism that is configured to join the outer layer with the inner layer.

16. The article of footwear according to claim 15, wherein the upper liner portion of the inner liner further comprises an embossed battery area; and wherein the embossed battery area extends outwards from an outer surface of the upper liner portion.

17. The article of footwear according to claim 16, wherein the battery compartment area includes a recess disposed along the outer layer that corresponds to the embossed battery area.

18. The article of footwear according to claim 17, further comprising a securing member within the battery compartment area that is configured to hold the power source within the recess.

19. The article of footwear according to claim 15, wherein the fastening mechanism is a zipper.

20. The article of footwear according to claim 15, wherein the heating element is a toe cap heating element having a rectangular and arcuate geometry.

* * * * *